US006668777B2

(12) United States Patent
Sluka et al.

(10) Patent No.: US 6,668,777 B2
(45) Date of Patent: Dec. 30, 2003

(54) ARRANGEMENT FOR THE RELATIVE ANGLE-OF-ROTATION ADJUSTMENT OF A CAMSHAFT OF AN INTERNAL-COMBUSTION ENGINE WITH RESPECT TO A DRIVING WHEEL

(75) Inventors: Gerold Sluka, Neckartailfingen (DE); Edwin Palesch, Lenningen (DE); Alfred Trzmiel, Grafenberg (DE)

(73) Assignees: Dr. Ing. h.c.F. Porsche Aktiengesellschaft, Stuttgart (DE); Hydraulik Ring GmbH, Nürtingen (DE)

( * ) Notice: Subject to any disclaimer, the term of this patent is extended or adjusted under 35 U.S.C. 154(b) by 0 days.

(21) Appl. No.: 10/221,950

(22) PCT Filed: Jan. 30, 2002

(86) PCT No.: PCT/EP02/00927

§ 371 (c)(1),
(2), (4) Date: Sep. 18, 2002

(87) PCT Pub. No.: WO02/073008

PCT Pub. Date: Sep. 19, 2002

(65) Prior Publication Data

US 2003/0106512 A1 Jun. 12, 2003

(30) Foreign Application Priority Data

Mar. 14, 2001 (DE) ..... 101 12 206

(51) Int. Cl.[7] ..... F01L 1/34

(52) U.S. Cl. ..... 123/90.17; 123/90.18; 92/5 R; 92/6 R; 92/120; 464/2

(58) Field of Search ..... 123/90.11–90.18, 123/90.27, 90.31, 90.34; 92/5 R, 6 R, 60.5, 81, 120–126; 464/2, 160; 74/568 R

(56) References Cited

U.S. PATENT DOCUMENTS

| | | | | |
|---|---|---|---|---|
| 3,781,069 A | | 12/1973 | Gluchowicz | 308/5 R |
| 5,836,276 A | * | 11/1998 | Iwasaki et al. | 123/90.17 |
| 5,836,278 A | * | 11/1998 | Scheidt | 123/90.17 |
| 6,014,952 A | * | 1/2000 | Sato et al. | 123/90.17 |
| 6,311,656 B1 | * | 11/2001 | Watanabe | 123/90.17 |
| 6,390,043 B1 | * | 5/2002 | Niethammer et al. | 123/90.17 |

FOREIGN PATENT DOCUMENTS

| | | | |
|---|---|---|---|
| DE | 3024306 A1 | 1/1982 | F01L/1/18 |
| DE | 19745908 A1 | 4/1999 | |
| DE | 19930711 C1 | 8/2000 | |
| JP | 11-182216 | 7/1999 | F01L/1/34 |
| JP | 2000-240414 | 9/2000 | F01L/1/34 |

* cited by examiner

*Primary Examiner*—Thomas Denion
*Assistant Examiner*—Kyle Riddle
(74) *Attorney, Agent, or Firm*—Crowell & Moring LLP

(57) ABSTRACT

An arrangement is provided for relative angle-of-rotation adjustment of a camshaft of an internal-combustion engine with respect to a driving wheel. An interior part, non-rotatably connected with the camshaft, has at least approximately radially extending webs or vanes. A driven cell wheel has several cells distributed along the circumference and bounded by webs. The camshaft is rotatable by way of the webs or vanes between two end positions relative to the cell wheel, and the interior part is laterally bounded by two cover elements connected with the cell wheel. Recesses forming chambers are provided to reduce friction between the webs or vanes of the interior part and the cover elements in the side walls of the vanes directed to the cover elements. During operation of the internal-combustion engine, the recesses are at least partially acted upon by hydraulic oil.

2 Claims, 2 Drawing Sheets

ARRANGEMENT FOR THE RELATIVE ANGLE-OF-ROTATION ADJUSTMENT OF A CAMSHAFT OF AN INTERNAL-COMBUSTION ENGINE WITH RESPECT TO A DRIVING WHEEL

BACKGROUND AND SUMMARY OF THE INVENTION

This invention relates to an arrangement for the relative angle-of-rotation adjustment of a camshaft of an internal-combustion engine with respect to a driving wheel.

A so-called vane cell camshaft adjuster is known from German Patent Document DE 197 45 908 A1. In this case, recesses are provided on the faces of the rotor vanes in which roll-shaped roll bodies are accommodated. These roll bodies are used for reducing the friction forces between the driving wheel and the rotor. Roller bodies are supported on one side directly in the recess and, on the other side, directly at the interior wall of the driving wheel. Furthermore, it is suggested in a modified embodiment to admit pressure oil to a duct leading to the free face of the rotor vane in order to also reduce the friction forces between the driving wheel and the rotor.

It is an object of the invention to improve an arrangement of the above-mentioned type for the relative angle-of-rotation adjustment of a camshaft with respect to its driving wheel such that the friction power generated between the driving wheel and the rotor is reduced further.

This object is achieved by the claimed invention.

As a result of the pressure chambers provided in the side walls of the rotor vanes, because of the thereby reduced friction surfaces, the friction resistance between the driving wheel and the rotor can be reduced considerably. As a result, a fast, low-wear and reliable adjustment of the desired inlet and outlet times for the valves of the internal-combustion engine can be achieved.

Further advantages and advantageous further developments of the invention are contained in dependent claims and in the description.

Pressure admission to the two pressure chambers provided in a side wall of the rotor vanes advantageously takes place by way of respective openings connected with the pressure spaces adjoining the blades. As a result, the feeding of pressure oil for adjusting the interior part or the rotor can simultaneously be used for the admission of pressure to the pressure chambers provided in the rotor blades. Additional pressure lines for supplying the pressure chambers are therefore not required.

An embodiment of the invention will be explained in detail in the description which follows and in the drawings.

DETAILED DESCRIPTION OF THE INVENTION

Figure 2:
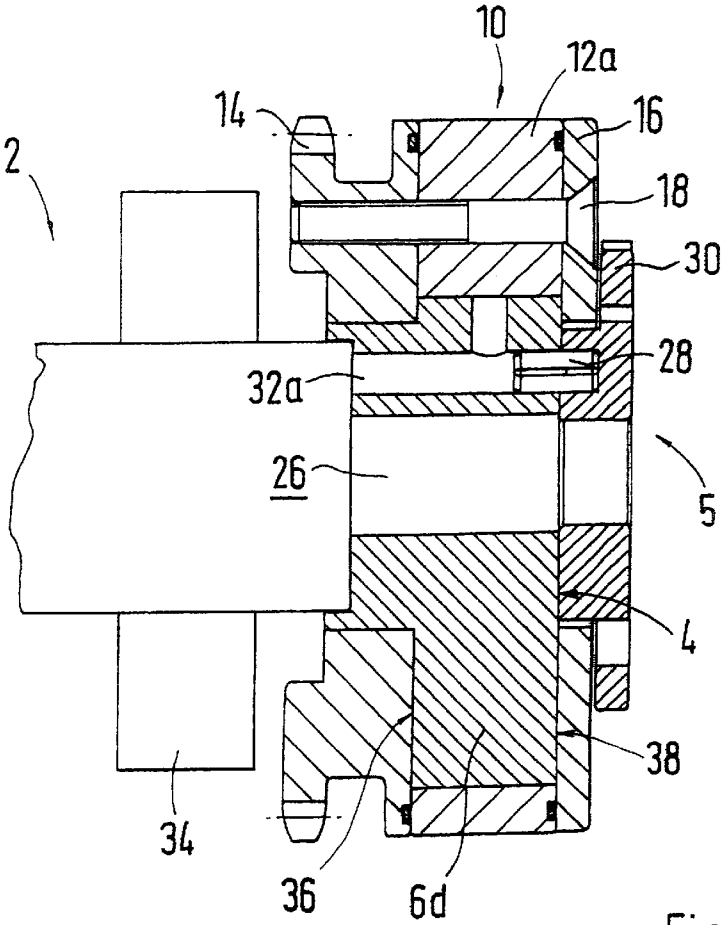
FIG. 2 is a sectional view along line II—II in FIG. 1.

In the drawings, reference number 2 indicates a schematically outlined camshaft of an internal-combustion engine at whose free end an interior part, in the following called rotor 4, of an adjusting unit 5 is arranged. In this embodiment, the rotor 4 is equipped with five radially arranged vanes 6*a* to 6*e* which originate from a hub 8 of the rotor 4. In the area of its vanes 6*a* to 6*e*, a cell wheel 10 reaches around the rotor 4, which cell wheel 10 is provided with five inward-projecting radial webs 12*a* to 12*e*. The cell wheel 10 forming the stator of the adjusting unit 5 is closed off by a chain wheel 14 on its face facing the camshaft 2, which chain wheel 14 is rotatably and sealingly guided on the hub 8 of the rotor 4. The chain wheel 14 is used as a drive for the camshaft 2 which takes place, for example, by way of a drive chain connected with the crankshaft. The opposite side of the cell wheel 10 is closed by a disk 16, the chain wheel 14 and the disk 16 being fixedly connected with the cell wheel 10 by way of fastening screws 18. The passage bores 20 provided in the webs 12*a* to 12*e* in the cell wheel 10 are used for receiving or guiding these fastening screws 18. By means of the webs 12*a* to 12*e* of the cell wheel 10, five cells which are bounded by the chain wheel 14 and the disk 16 in the axial direction are constructed. The cells are divided into two pressure spaces 22*a* to 22*e* and 24*a* to 24*e* respectively by means of the vanes 6*a* to 6*e* of the rotor 4. The rotor 4 and the cell wheel 10 rotatably guided on the latter are fastened by means of a cap screw (not shown) to the camshaft 2. The hub 8 has a central bore 26 for receiving the cap screw.

By means of two dowel pins 28 and the cap screw, a signal generator disk 30 is fastened to the exterior side of the rotor 4. By means of this signal generator disk 30, the rotating position of the camshaft 2 with respect to the crankshaft can be detected. The five axial bores 32*a* to 32*e* arranged in the hub 8 of the rotor 4 represent a portion of the oil supply ducts for the pressure spaces 24*a* to 24*e*. The pressure spaces 22*a* to 22*e* are also supplied with hydraulic oil by way of radially extending bores (not shown) arranged in the hub 8. The hydraulic oil supply for the two pressure spaces 22*a* to 22*e* and 24*a* to 24*e* respectively takes place by way of a camshaft bearing 34 to which the corresponding control lines of the oil pressure supply of the adjusting unit 5 are connected. The manner of the oil supply to the pressure spaces 22*a* to 22*e* and 24*a* to 24*e* respectively is known, for example, from German Patent Document DE 199 30 711 C1, so that the precise construction of the oil feeding ducts to the pressure spaces does not have to be discussed in detail.

The side wall 36 adjoining the chain wheel 14 and the side wall 38 of the vanes 6*a* to 6*e* adjoining the disk 16 each have two recesses 40 and 42 respectively forming a pressure chamber, which recesses 40 and 42 are both separated from one another by a center web 44. By way of a duct 46, the pressure chambers 40 are connected with the pressure spaces 22*a* to 22*e*, and by way of a duct 48, the pressure chambers 42 are connected with the pressure spaces 24*a* to 24*e*. The two chambers 40 and 42 constructed on one lateral surface of the vanes 6*a* to 6*e* respectively extend essentially along the entire lateral surface.

Figure 1:
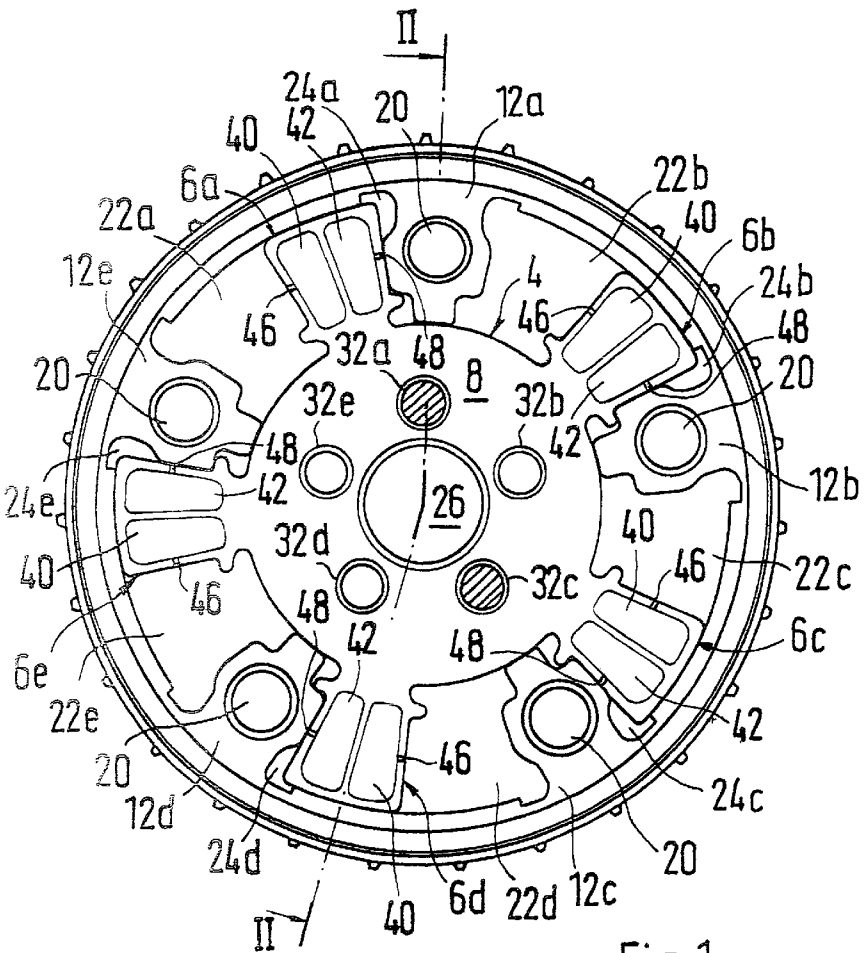
FIG. 1 is a sectional view of a camshaft adjuster.
Figure 3:
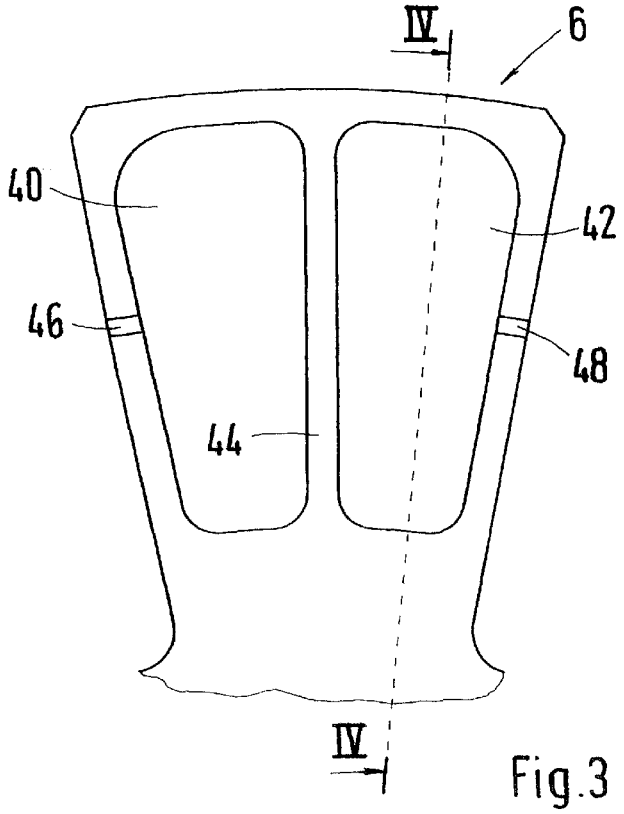
FIG. 3 is an enlarged representation of a rotor vane.
Figure 4:
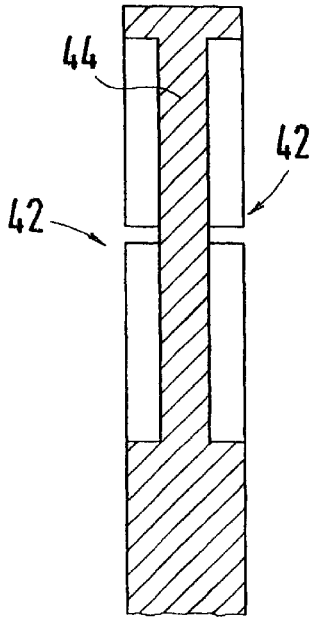
FIG. 4 is a sectional view along line IV—IV in FIG. 3.
Figure 5:
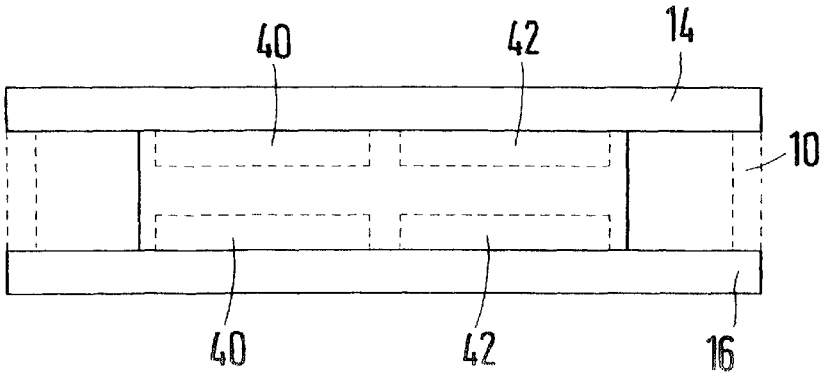
FIG. 5 is a view of the face of a rotor vane in the assembled condition of the camshaft adjuster.

As a function of the adjusting direction, a pressure cushion is built up reciprocally in the pressure chambers 40 and 42 respectively, which pressure cushion contributes to the reduction of friction between the vanes 6*a* to 6*e* and the adjoining chain wheel 14 and the disk 16. If the rotor 4 is to be rotated clockwise (see FIG. 1) with respect to the cell wheel 10, hydraulic oil is admitted to the pressure spaces 22*a* to 22*e*. By way of the pressure spaces 22*a* to 22*e*, the hydraulic oil arrives by way of the ducts 46 in the pressure chambers 40 in which a corresponding pressure cushion is built up. If the rotor 4 is to be built up relative to the cell wheel 10 counterclockwise, analogously, hydraulic oil is admitted to the pressure spaces 24*a* to 24*e*. In this case, the hydraulic oil arrives by way of the pressure spaces 24*a* to 24*e* and the ducts 48 in the pressure chambers 42, so that a friction reducing pressure cushion is also formed in this adjusting direction in the lateral area of the vanes 6*a* to 6*e*.

What is claimed is:

1. An arrangement for relative angle-of-rotation adjustment of a camshaft of an internal-combustion engine with respect to a driving wheel, comprising:

an interior part non-rotatably connected with the camshaft, the interior part having at least approximately radially extending webs or vanes, a driven cell wheel which has several cells distributed along the circumference and bounded by webs, each of the cells being divided by one of the webs or vanes of the interior part into two pressure spaces, the webs or vanes being angularly movably guided in the cells when hydraulic pressure is admitted to or removed from the pressure spaces by way of control lines, the camshaft being rotatable by way of the webs or vanes between two end positions relative to the cell wheel, and two cover elements connected with the cell wheel laterally bounding the interior part, wherein, for reduction of friction between the webs or vanes of the interior part and the cover elements in side walls of the vanes directed to the cover elements, recesses forming chambers are provided which, during operation of the internal-combustion engine, are at least partially acted upon by hydraulic oil.

2. The arrangement according to claim 1, wherein, in at least one of the side walls of the vanes, two separate chambers are provided which, by way of respective openings, are connected with the pressure spaces adjoining the vanes.

* * * * *